US011951541B2

(12) United States Patent
Delsine et al.

(10) Patent No.: US 11,951,541 B2
(45) Date of Patent: Apr. 9, 2024

(54) ROBOTIZED LADLE TURRET SYSTEM

(71) Applicant: Vesuvius Group, S.A., Ghlin (BE)

(72) Inventors: Damien Delsine, Ghlin (BE); Jean-Luc Renard, Ghlin (BE); Xingqi Fan, Ghlin (BE)

(73) Assignee: Vesuvius Group, S.A., Ghlin (BE)

( * ) Notice: Subject to any disclaimer, the term of this patent is extended or adjusted under 35 U.S.C. 154(b) by 98 days.

(21) Appl. No.: 17/800,561

(22) PCT Filed: Feb. 17, 2021

(86) PCT No.: PCT/EP2021/053854
§ 371 (c)(1),
(2) Date: Aug. 18, 2022

(87) PCT Pub. No.: WO2021/165299
PCT Pub. Date: Aug. 26, 2021

(65) Prior Publication Data

US 2023/0145288 A1 May 11, 2023

(30) Foreign Application Priority Data

Feb. 18, 2020 (EP) ..... 20157812

(51) Int. Cl.
*B22D 41/13* (2006.01)
*B22D 41/015* (2006.01)
(Continued)

(52) U.S. Cl.
CPC ..... *B22D 41/13* (2013.01); *B22D 41/015* (2013.01); *B22D 41/24* (2013.01); *B22D 41/38* (2013.01); *B22D 41/56* (2013.01)

(58) Field of Classification Search
CPC ..... B22D 41/13; B22D 41/56
See application file for complete search history.

(56) References Cited

U.S. PATENT DOCUMENTS 3,717,331 A 2/1973 Simons
8,498,740 B2 * 7/2013 Truttmann ..... B22D 41/22 222/597

(Continued)

FOREIGN PATENT DOCUMENTS

KR 20040021971 A 3/2004
KR 1020040021971 A * 3/2004
KR 20160065651 A 6/2016

OTHER PUBLICATIONS

International Search Report for PCT/EP2021/053854, dated May 17, 2021.

*Primary Examiner* — Kevin E Yoon
(74) *Attorney, Agent, or Firm* — MaxGoLaw PLLC

(57) ABSTRACT

A metal casting installation is provided that includes a loading platform, a tundish,
a first ladle and a second ladle, each of the first and second ladle has a floor provided with an opening, a collector nozzle and a ladle shroud. The installation also includes a ladle sliding gate configured for moving the collector nozzle and the ladle shroud between a sealed position, a casting position, and an unclogging position. A turret is provided for holding the first and second ladles, configured for moving and holding in place the first and second ladles between a loading station and a casting station over the tundish. A robot is also provided and configured for loading a new ladle shroud onto the ladle slide gate, and coupling a driving device to the ladle slide gate.

16 Claims, 4 Drawing Sheets

(51) Int. Cl.

| | |
|---|---|
| ***B22D 41/24*** | (2006.01) |
| ***B22D 41/38*** | (2006.01) |
| ***B22D 41/56*** | (2006.01) |

(56) References Cited

U.S. PATENT DOCUMENTS

| | | | | |
|---|---|---|---|---|
| 2006/0118268 | A1* | 6/2006 | Collura ..... | B22D 41/42<br>266/233 |
| 2008/0314938 | A1 | 12/2008 | Ebner et al. | |

* cited by examiner

ROBOTIZED LADLE TURRET SYSTEM

FIELD OF THE INVENTION

The present invention relates to a robotized loading station for preparing a fresh ladle loaded on a rotating turret before being brought to a casting station over a tundish. In particular, the present invention concerns a robotized installation for loading a ladle shroud to a ladle sliding gate coupled to an outlet of the ladle, and for coupling a driving device to both ladle and ladle sliding gate for actuating the ladle sliding gate. The robotized loading station is also configured for de-coupling the driving device and unloading a spent ladle shroud off an emptied ladle recently removed from the casting station over the tundish. The robotization of these operations saves the operators from a strenuous task and enhances reproducibility of the operations. A specific ladle sliding gate comprising a collector nozzle positioned next to the ladle shroud allows a swift unclogging of the outlet, should the latter become clogged.

BACKGROUND OF THE INVENTION

In continuous metal forming processes, metal melt (2) is transferred from one metallurgical vessel to another, to a mould or to a tool. For example, as shown in FIG. 1A-F a ladle (11, 12) is filled with metal melt out of a furnace (not shown) and transferred over a tundish (1) to discharge the molten metal from the ladle through a ladle shroud (13*a*-13*c*) into the tundish. The metal melt can then be cast through a pouring nozzle (3) from the tundish to a mould or tool for continuously forming slabs, billets, beams, thin slabs, and the like. Flow of metal melt out of the ladle into the tundish and out of the tundish into the mould or tool is driven by gravity. The flow rates can be controlled by sliding gates in fluid communication with an outlet of the ladle and tundish. A ladle sliding gate (15) can be used to control the flow rate off the ladle and even interrupt the flow at a sealed position. Similarly, a tundish sliding gate (5) can be used to control the flow rate off the tundish and interrupt the flow in a sealed position.

Since casting of metal into a mould or tool is to run continuously, the tundish plays the role of a buffer and the level of molten metal in the tundish must remain substantially constant during the whole casting operation. Maintaining the level of molten metal in the tundish substantially constant requires a rapid swap of a new ladle filled with molten metal with an old ladle after it has been emptied, to ensure a quasi-continuous feed of molten metal to the tundish, such that metal is poured into the tundish at substantially the same rate as it flows out thereof into the mould or the tool. This operation is rendered more complex by the following constraints.

First, since for safety reasons and to avoid any collision, a ladle (11,12) cannot be carried over a workshop from the furnace to a corresponding tundish with a ladle shroud (13*a*-13*c*) coupled to a bottom floor of the ladle and extending 1 m or more below the bottom floor, the ladle shroud must be coupled to the bottom floor of the ladle at a loading station located close to the tundish.

Second, to prevent metal contained in the second ladle (12) from freezing in contact with 'cold' moving parts of the ladle sliding gate (15) maintained in sealed position thus avoiding gripping the mechanism and preventing the opening of the ladle sliding gate, the inner bore of the inner nozzle is generally filled with a plugging material (19), usually sand or other particulate materials, to prevent any metal melt from reaching the gate mechanism, such that metal freezing and clogging of the nozzle and gate system are prevented. Upon opening the ladle sliding gate to a casting position with the ladle located at the casting station, the sand flows out followed by molten metal which can flow through the ladle shroud into the tundish. Sometimes, however, the plugging material is locally bound with frozen metal forming a solid plug preventing the plugging material from flowing out. The inner nozzle is therefore clogged, and no metal can flow out of the ladle into the tundish in spite of the ladle sliding gate being in the casting position. This problem can easily be solved with an unclogging tool (19*r*) inserted into or close to the bore of the inner nozzle. The unclogging tool (19*r*) can be a pressurized gas lance or an elongated rod, as illustrated in FIGS. 2C and 3C. Now, this apparently simple operation is actually quite complex because of the long ladle shroud (13*a*-13*c*) which is coupled to the ladle sliding gate.

For this reason, in most installations, the ladle shroud is not coupled to the sliding gate in an autonomous way at the loading station, but it is inserted over a collector nozzle and held in place by a robot at the casting station instead. This allows the ladle shroud to be removed from the collector nozzle by the robot in case of clogging of the ladle outlet, for easier access thereto from the bottom with an unclogging tool (19*r*). Once the clogged passage is unclogged, the ladle sliding gate can move into the sealing position while the robot reintroduces the ladle shroud over the collector nozzle. At this point the ladle sliding gate moves back into the casting position to start casting molten metal into the tundish.

A newly filled ladle is transported from the furnace to a casing installation with a ladle sliding gate fixed to a bottom floor of the ladle, but without a driving device to actuate the relative movements of the plates forming the ladle sliding gate. For this reason, many metallurgic installations use a turret (30) comprising a first holding device for holding a first ladle (11) at a casting station over the tundish (1) and a second holding device for holding a second ladle (12) full of molten metal at a loading station. While the first ladle discharges the molten metal contained therein into the tundish, the second ladle can be prepared for performing the same operation once the first ladle is emptied. In particular, a driving device, such as a hydraulic piston can be coupled to the bottom floor of the ladle and to the ladle sliding gate, to allow actuation thereof.

US2006/0118268 describes a ladle sliding gate configured for autonomously holding a ladle shroud as well as a collector nozzle, set side by side. One or more driving devices, such as hydraulic pistons, can be used to actuate the ladle sliding gate by moving plates thereof between a sealed position wherein the opening is sealed, a casting position wherein the opening is in fluid communication with the ladle shroud, and an unclogging position wherein the opening is in fluid communication with the collector nozzle. This way, in case of clogging of the inner bore, the ladle sliding gate moves to the unclogging position, so that the unclogging tool (19*r*) can easily be introduced through the short collector nozzle bore to break the solidified metal bonded plugging material. Once the plugging material can flow again, the ladle sliding gate moves the collector nozzle out of registry from the ladle outlet and brings the ladle shroud into casting position to allow molten metal to flow through the ladle shroud into the tundish. Handling of the unclogging tool (19*r*) can advantageously be performed by a robot located adjacent to the casting station. A clear advantage over the holding of the ladle shroud by a robot described above, is that with this ladle sliding gate, no robot is required to hold the ladle shroud and it can be used instead to the unclogging tool (19*r*). Else, this operation must be performed manually by a human operator or a second robot must be installed adjacent to the casting station to unclog the inner bore. Manual handling is generally more laborious and takes longer time than when a robot performs this operation. This is disadvantageous because the longer time the tundish is not fed with fresh molten metal by the ladle, lower is the level of molten metal in the tundish, and/or the longer time the casting operation must be run at lower flow rate which is disruptive of the quality of the beam thus produced. Examples of ladle sliding gates of this type holding a collector nozzle and a ladle shroud side-by-side are illustrated in FIGS. 2A-D and 3A-D and are discussed more in detail in continuation.

U.S. Pat. No. 8,215,375 describes a continuous casting plant having at least one multifunction robot for implementing a plurality of different process-controlled or automated interventions at the continuous casting plant. The multifunction robot arranged on a pivotable arm at a rotary column fastened to the pouring platform of the continuous casting plant and the robot can be pivoted with the pivot arm between a retraction position and a working position. The robot is also movable with respect to its arm.

The operation of swift swapping an emptied first ladle with a filled second ladle at the casting station remains a delicate operation. This operation is rendered even more critical in case of clogging of the inner bore, which can increase the time during which the tundish is not replenished with fresh molten metal. A need for a reproducible and shorter ladle swapping operation is sought in the metal casting industry. The present invention proposes a metal casting installation with fully automated ladle changing operations, including in case of clogging of the outlet of a ladle by frozen plugging material (19) allowing a reproducible and in all cases shorter swapping operation. These and other advantages of the present invention are explained more in detail in the following sections.

SUMMARY OF THE INVENTION

The objectives of the present invention have been reached with a metal casting installation comprising, (a) a loading platform, (b) a tundish, (c) a first ladle and a second ladle, each of the first and second ladle comprising, a floor provided with an opening, a collector nozzle and a ladle shroud, a ladle sliding gate configured for reversibly receiving and supporting the collector nozzle and the ladle shroud, and further configured for being coupled to a driving device for actuating the ladle sliding gate between a sealed position wherein the opening is sealed, a casting position wherein the opening is in fluid communication with the ladle shroud, and an unclogging position wherein the opening is in fluid communication with the collector nozzle, (d) a turret comprising at least a first holding device and a second holding device for holding the first ladle and the second ladle, respectively, wherein the ladle turret is configured for moving and holding in place the first and second ladles between a loading station, adjacent to the loading platform, and a casting station, over the tundish, wherein, the metal casting installation comprises a robot configured for carrying out the following operations on the first or second ladle which is held in the loading station, loading a new ladle shroud onto the ladle slide gate, and coupling a driving device to the ladle slide gate The robot is preferably also configured for removing off the emptied first or second ladle which is held at the loading station after being moved from the casting station, the ladle shroud and the driving device.

It is preferred that the loading platform comprises a tool storage rack containing one or more spare ladle shrouds within reaching distance of the robot. The spare ladle shroud can be pre-heated in the storage rack or in a separate oven. The storage rack preferably comprises one or more driving devices and/or additional spare collector nozzles, and/or tools.

In a preferred embodiment, the robot is movingly mounted on the loading platform such that the robot can translate parallel to a first axis (X) and/or second axis (Y) normal to the first axis (X), or combination thereof, and/or rotate about a vertical axis (Z) normal to the first and second axes (X, Y), in order to reach and retrieve any tool or component from the storage rack and to reach the ladle sliding gate of the first or second ladle which is held at the loading station for carrying out the operations of loading/unloading a ladle shroud and of coupling/removing a driving device.

The ladle sliding gate is important for the present invention. In a first embodiment, the ladle sliding gate comprises, (a) an upper plate comprising, a fixing surface and a bottom sliding surface separated from one another by a thickness of the upper plate, an upper bore extending from the fixing surface to the bottom sliding surface, and wherein the fixing surface of the upper plate is rigidly fixed to a lower portion of the corresponding first or second ladle with the upper bore in fluid communication with the opening, (b) A lower plate comprising, a nozzle sliding surface and a top sliding surface separated from one another by a thickness of the lower plate, a lower bore extending from the top sliding surface to the nozzle sliding surface, wherein the lower plate is slidingly mounted such that the top sliding surface can slide in translation along the bottom sliding surface to bring the lower bore in and out of fluid communication with the upper bore, and wherein (c) a drawer configured for rigidly holding a ladle shroud having a shroud bore opening at an upper shroud surface and a collector nozzle having a collector bore opening at an upper collector surface, the drawer being movingly mounted such as to translate the upper shroud surface and collector surface along the nozzle sliding surface of the lower plate between a shroud position, wherein the shroud bore is in fluid communication with the lower bore and a collector position, wherein the collector bore is in fluid communication with the lower bore, (d) the driving device being coupled to the lower plate for driving the translation of the lower plate, and (e) a drawer driving device being coupled to the drawer for driving the translation of the drawer, wherein the driving device is coupled to the lower plate and comprises a cylinder rigidly and reversibly coupled to the bottom portion of the corresponding first or second ladle, and a piston rigidly and reversibly fixed to the lower plate, the driving device being configured for moving the lower plate to bring the lower bore in and out of registry with the upper bore, and wherein the drawer driving device is coupled to the drawer and comprises a cylinder rigidly and reversibly coupled to the bottom portion of the corresponding first or second ladle, and a piston rigidly and reversibly fixed to the drawer, the drawer driving device being configured for moving the drawer to bring the shroud bore and the collector bore in and out of registry with the lower bore.

In an alternative embodiment, the ladle sliding gate comprises, (a) an upper plate comprising,
- a fixing surface and a bottom sliding surface separated from one another by a thickness of the upper plate,
- an upper bore extending from the fixing surface to the bottom sliding surface, and wherein
- the fixing surface of the upper plate is rigidly fixed to a lower portion of the corresponding first or second ladle with the upper bore in fluid communication with the opening, (b) A lower plate comprising,
- a nozzle surface and a top sliding surface separated from one another by a thickness of the lower plate,
- a first bore and a second bore, each extending from the top sliding surface to the nozzle surface, wherein
- the lower plate is slidingly mounted such that the top sliding surface can slide along the bottom sliding surface to bring each of the first and second bores in and out of fluid communication with the upper bore, and wherein
- the nozzle surface is configured for being rigidly and reversibly coupled to the ladle shroud having a ladle bore in fluid communication with the first bore, and to the collector nozzle having a collector bore in fluid communication with the second bore, and wherein the driving device is coupled to the lower plate and comprises a cylinder rigidly and reversibly coupled to the bottom portion of the corresponding first or second ladle, and a piston rigidly and reversibly fixed to the lower plate, the driving device being configured for moving the lower plate to bring the first and second bores in and out of registry with the upper bore.

The driving device can be actuated hydraulically or pneumatically or electrically. Each of the at least first holding device and second holding device of the ladle turret can be provided with,

- a source of pressurized fluid for activating the driving device via a hose, or a source of electric power, and
- preferably a storing station for storing a driving device ready for coupling to a ladle sliding gate.

In a preferred embodiment, a pre-heating oven is provided for bringing and maintaining at a pre-heating temperature the new ladle shroud loaded on the ladle sliding gate of the first or second ladle located at the loading station. This pre-heating oven can be provided instead of, or additionally to a heating storage rack or a separate oven for pre-heating a new ladle shroud before it is coupled to the ladle.

In a preferred embodiment, the robot is also configured,

- for checking a state of a spent ladle shroud after removal from an emptied ladle,
- for assessing whether the spent ladle shroud can be re-used after cleaning or whether it must be disposed of, and
- for cleaning the spent ladle shroud, advantageously with an oxygen shower, to remove any residue clinging to walls of the spent ladle shroud.

The present invention also concerns a method for casting a molten metal comprising the following steps, (a) providing a metal casting installation as described supra, wherein,
- the first ladle is full of molten metal and is in the casting station and
- the second ladle is full of molten metal and is in the loading station,
- the ladle sliding gate of the first ladle is in the sealed position, is coupled to one or more driving devices or optionally drawer driving devices, and is provided with a ladle shroud and a collector nozzle,
- the ladle sliding gate of the second ladle is in the sealed position and comprises no ladle shroud and no operational driving device and no operational drawer driving device, (b) bringing the ladle sliding gate of the first ladle into casting position for casting molten metal from the first ladle through the ladle shroud into the tundish, (c) during the preceding step,
- loading with the robot a new ladle shroud onto the ladle sliding gate of the second ladle, and
- coupling with the robot the driving device to the sliding plate gate of the second ladle, (d) When the first ladle is substantially empty, bringing the ladle sliding gate of the first ladle into sealed position, followed by (e) swapping positions of the first and second ladles by moving the first ladle from the casting station to the loading station and, concomitantly, moving the second ladle from the loading station to the casting station, (f) bringing the ladle sliding gate of the second ladle into casting position and casting molten metal from the second ladle through the ladle shroud into the tundish.

In a preferred embodiment, the method comprises the following steps during step (f), (g) removing with the robot the spent ladle shroud from the ladle sliding gate of the emptied first ladle and storing the spent ladle shroud for refurbishing or as waste, and (h) de-coupling and removing with the robot the one or more driving devices from the sliding plate gate of the first ladle, and storing them for further use, (i) removing the emptied first ladle, and (j) loading a new ladle full of molten metal onto the first holding device of the ladle turret at the loading station wherein, like the second ladle in step (a), the new ladle comprises a ladle sliding gate in the sealed position and comprising no ladle shroud.

In many instances, the opening of the first ladle is filled with a plugging material to prevent metal from solidifying in contact with cold surfaces of the upper plate of the ladle sliding gate. The plugging material is generally in a particulate form. In some cases, some molten metal percolates through the particulate plugging material and solidifies forming a solid mass which clogs the opening, preventing any molten metal from flowing out of the opening upon bringing the ladle sliding gate of the first ladle into casting station in step (b). When such clogging occurs, the following steps can be carried out to unclog the opening.

bringing the ladle sliding gate of the first ladle into unclogging position, with an appropriate unclogging tool, unclogging the opening of the first ladle by disrupting the plugging material, when the plugging material starts flowing out of the collector nozzle, bringing the ladle sliding gate of the first ladle into casting position for casting molten metal from the first ladle through the thus unplugged opening and through the ladle shroud into the tundish.

Step (e) of swapping positions of the first and second ladles preferably comprises the following steps, lifting the first and second ladles until the ladle shrouds of the first and second ladles are both clear off and higher than the tundish in a vertical direction (Z), rotating the turret about the vertical axis (Z) by 180° to bring the first ladle above the loading station, and to bring the second ladle above the casting station and above the tundish, lowering the first and second ladles to their respective loading and casting stations, the ladle shroud of the second ladle being inserted in the tundish.

In a preferred embodiment, the robot also, checks a state of a spent ladle shroud after removal from an emptied ladle, assesses whether the spent ladle shroud can be re-used after cleaning or whether it must be disposed of, and cleans the spent ladle shroud, with an oxygen shower, to remove any residue clinging to walls of the spent ladle shroud.

BRIEF DESCRIPTION OF THE FIGURES

On these figures.

DETAILED DESCRIPTION

Figure 1A:
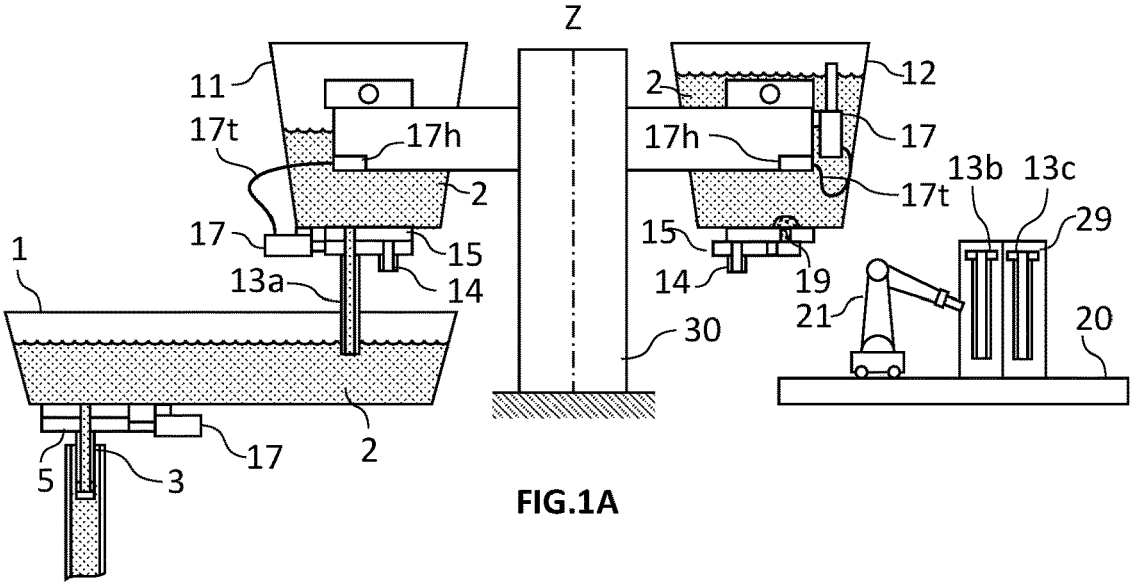
FIG. 1A-F depicts various steps of a swap of an emptied first ladle away from the casting station and replacement thereof by a full second ladle after preparation thereof at the loading station.

As illustrated in FIG. 1A-F, a metal casting installation according to the present invention comprises a first ladle (11) and a second ladle (12). The first ladle is held at a casting station over a tundish (1) for transferring molten metal (2) contained in the first ladle (11) into the tundish (1). The tundish delivers the molten metal to a tool or a mould. With this system, the tundish contains a volume of molten metal which remains substantially constant throughout the transfer of molten metal from the first ladle (11) to the tundish (1). When the first ladle has been emptied of its content, it must be replaced as rapidly as possible by the second ladle (12) full of molten metal and fully geared for continuing the transfer of molten metal (2) to the tundish (1), to keep substantially constant the level of molten metal in the tundish and, at the same time, the flow rate of molten metal out of the tundish into the tool or mould.

A ladle (11,12) comprises, a floor provided with an opening (11*o*, 12*o*). An inner nozzle (18) provided with an inner bore brings an inner volume of the tundish in fluid communication with the opening (11*o*, 12*o*). The ladle (11,12) also comprises a ladle sliding gate (15) configured for reversibly receiving and supporting the ladle shroud, and for being coupled to a driving device (17) for actuating the ladle sliding gate between a sealed position wherein the opening is sealed, and a casting position wherein the opening is in fluid communication with the ladle shroud (13*a*-13*c*).

The ladle sliding gate (15) of a ladle according to the present invention is also configured for reversibly receiving and supporting a collector nozzle (14*a*, 14*b*). The driving device (17) or drawer driving device (17*w*) is further configured for actuating the ladle sliding device (15) to an unclogging position wherein the opening is in fluid communication with the collector nozzle (14). As explained more in detail below, the unclogging position is used in case no molten metal flows out of the ladle when the ladle sliding gate is in the casting position due to clogging.

To accelerate the swap between an emptied first ladle (11) with a full second ladle (12), the first and second ladles are supported by corresponding first and second holding devices of a rotating turret (30) (cf. FIG. 1A). The first and second holding devices are fork shaped arms holding the first and second ladles (11,12) at "arm-length" from a central rotating axis (Z). The rotation of the turret about the central rotating axis (Z) allows the first and second ladles to be moved between, the casting station wherein one of the first or second ladle (11, 12) is held over the tundish with a ladle shroud (13*a*-13*c*) partly inserted inside the tundish, and a loading station, wherein the other one of the first or second ladle is geared at a loading station in preparation to the transfer of molten metal into the tundish when it is moved into the casting station.

Because the ladle shroud (13*a*-13*c*) is partly inserted in the tundish (1), the turret (30) must first lift the first and second ladles to drive the ladle shroud (13*a*) of the first ladle (11) out and above the tundish (1) prior to rotating about the central rotating axis (Z) to avoid the ladle shrouds of the first and second ladles to collide with the tundish.

The loading is provided with a loading platform (20) comprising tools and spare parts, such as new ladle shrouds (13*b*, 13*c*), new collector nozzles (14), or spare driving devices (17). As explained supra, a ladle cannot be transported across a workshop between a furnace and a casting installation with a long ladle shroud (13*a*-13*c*) protruding out of the bottom floor thereof. Consequently, a fresh ladle, full of molten metal, reaches the casting station devoid of a ladle shroud (13*a*-13*c*). The fresh ladle (11, 12) full of molten metal (2) reaches the turret (30) with a ladle sliding gate (15) fixed to the bottom floor of the ladle but without an operational driving device (17), and with a collector nozzle (14) coupled to the ladle sliding gate. The collector nozzle is very short and can travel across the workshop attached to the ladle without any risk of collision. A new ladle shroud (13*a*-13*c*) can therefore be coupled to the fresh ladle (12) when the latter is docked on the turret (30) at the loading station. At the same time, a driving device (17) must be coupled to the ladle (11, 12) and the ladle sliding gate (15) and must be activated by connecting it to a source of pressurized fluid for hydraulic or pneumatic driving devices (17), or to a source of electric power for electric driving devices (17).

Rather than carrying out these operations manually by a human operator, the present invention proposes to provide a robot (21) on or adjacent to the loading platform (20). The robot (21) is configured for loading a new ladle shroud (13*b*) onto the ladle slide gate (15), and for coupling a driving device (17) to the ladle slide gate (15).

Casting Installation

FIG. 1A-F illustrates various steps of a continuous casting operation with an installation according to the present invention. The swapping of an emptied first ladle (11) with a filled second ladle (12) is discussed more in detail in the following sections. FIG. 1A shows a turret (30) comprising a first and second holding devices for holding first and second ladles (11, 12). The turret is located adjacent to a tundish, such that each of the first and second holding devices can bring a ladle (11, 12) to the casting station, with the ladle shroud partly inserted in the tundish below the level of molten metal contained in the tundish during use in stationary conditions. FIG. 1A shows such configuration, with a first ladle (11) partly filled with molten metal held at the casting station by the first holding device of the turret (30). The first ladle is over the tundish (1) with the ladle nozzle (13*a*-13*c*) partly inserted into the tundish and partly immerged below the level of molten metal contained in the tundish. The ladle sliding gate (15) of the first ladle (11) is coupled to a driving device (17) configured to move a plate of the sliding gate between the sealing, casting, and unclogging positions described supra. In the embodiment of FIG. 1A-F, the driving device (17) is a hydraulic piston which is connected to a source (17*h*) of pressurized fluid, through a tune (17*t*). The driving device (17) can be pneumatic or electric, but hydraulic driving devices are preferred.

A second ladle (12) full of molten metal, coming straight from a furnace, is held at the loading station by the second holding device of the turret (30), at the loading station, within robot reach of the loading platform (20). The ladle sliding gate (15) of the second ladle (12) is in the sealed position. Unlike the first ladle (11), the second ladle (12) is not ready for casting molten metal because it is devoid of any ladle shroud (13*b*) and of any driving device (17). It is possible to bring a second ladle (12) already equipped with a driving device (17), but not in an operational state, since it would not be connected to any source of pressurized fluid for hydraulic and pneumatic driving devices, nor to any source of electric power for electric driving devices. Generally, the second ladle (12) when reaching the turret is devoid of any driving device (17), and in the few instances where it is provided with a driving device, the latter is not operational.

The loading platform (20) comprises a storage rack (29) with various tools (not shown) required for preparing the second ladle (12) for casting, and with spare ladle shrouds (13*b*, 13*c*). The ladle shroud (13*a*, 13*c*) first in line for being coupled to a ladle is preferably preheated in the storage rack (29) or in a separate oven within reach of the robot, to avoid any brutal thermal shock when molten metal flows through the ladle shroud upon starting of the casting operation at the casting station. In some instances, the platform can comprise spare driving devices (17), and possibly spare collector nozzles (14), although a collector nozzle (14) is preferably coupled to the second ladle in a separate, refurbishing station, prior to filling the ladle with molten metal from the furnace.

The driving device (17) and optionally the drawer driving device (17*w*) (defined below with respect to the first embodiment illustrated in FIG. 2A-D) for actuating the ladle sliding gate (15) of the second ladle (12) is preferably stored on or at proximity of the second holding device of the turret (30). It is preferred to store the driving devices on the first and second holding devices because this way, it is not necessary to connect and disconnect the (drawer) driving devices each time it is coupled to and removed from a ladle, as the source (17*h*) of pressurized fluid is most conveniently also located on or at proximity of the first and second holding devices, as shown in FIG. 1A.

Figure 1B:
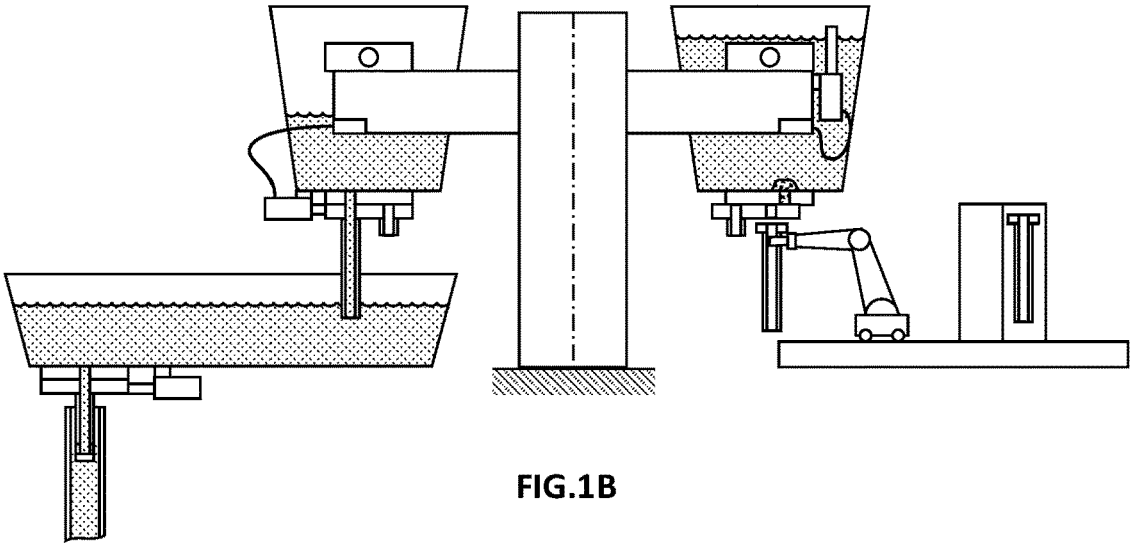

FIG. 1B shows that, while the first ladle (11) is discharging its content of molten metal into the tundish, the robot (21) takes a new ladle shroud (13*b*) from the storage rack (29) and couples the new ladle shroud to the ladle sliding gate (15) of the second ladle (12), which is maintained in the sealed position during the whole stay of the second ladle at the loading station. As explained supra, in a preferred embodiment, the new ladle shroud (13*b*) is heated to a pre-heating temperature in the storage rack (29) or in a separate oven within reach of the robot (21), prior to being loaded onto the ladle sliding gate. Pre-heating the ladle shroud prior to casting reduces the risks of cracking due to a brutal thermal shock as molten metal starts flowing through the ladle shroud at the beginning of a casting operation. As a second ladle (12) provided with a new ladle shroud (13*b*) can remain a certain time stationed at the loading station before being moved to the casting station, waiting for the first ladle (11) to be emptied, the new ladle shroud (13*b*) has time to cool down, losing all the benefit of the pre-heating operation. For this reason, in a preferred embodiment of the present invention illustrated in FIG. 1C, additionally or alternatively to pre-heating the new ladle shroud in the storage rack or separate oven, a pre-heating oven (25) can be provided at the loading station for (optionally bringing and) maintaining at the pre-heating temperature the new ladle shroud (13*b*) loaded on the ladle sliding gate (15) of the second ladle (12) located at the loading station. With this pre-heating oven (25), the ladle shroud arrives at the casting station at the required pre-heating temperature, and casting can start with lower risk of cracking due to thermal shocks. The pre-heating oven (25) can be movingly coupled to the loading platform (20), or to the first and second holding devices of the turret. It is preferably in the form of an open book, closing over the new ladle shroud (13*b*) once it has been loaded on the ladle sliding gate (15). The robot (21) can handle the oven to bring it into pre-heating position.

The robot (21) can preferably move along a horizontal plane (X, Y) and has several degrees of liberty, preferably at least five or at least seven degrees of liberty. The robot must be able to reach both the storage rack (29) to collect or deposit tools and or casting components, and also to reach the ladle sliding gate (15) of the ladle stationed at the loading station. It must have enough degrees of liberty for carrying out all the connections and de-connection and couplings and de-coupling required for ensuring a continuous casting operation of the casting installation.

Figure 1C:
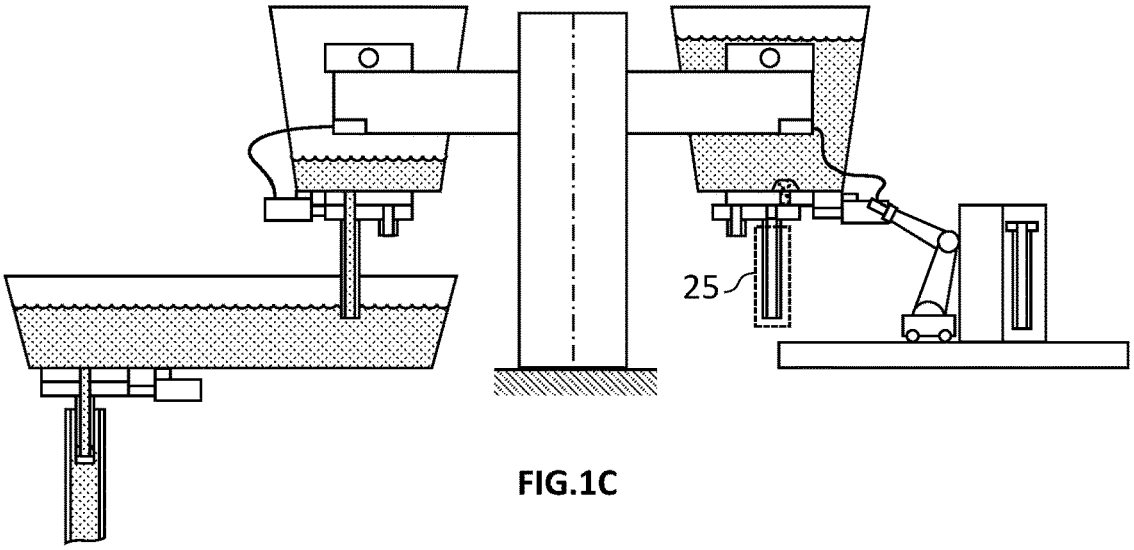

In particular, as shown in FIGS. 1B and 1C the robot must be configured for (de-)coupling a ladle shroud (13*a*-13*c*) and a (drawer) driving device (17, 17*w*), and for (de-)coupling a hose (17*t*) to (from) the (drawer) driving device (17, 17*w*). In FIG. 1A-D, the first and second holding devices of the turret (30) are provided with both,

- a storing station for storing one or more (drawer) driving devices (17, 17*w*) and
- a source of pressurized fluid connected to the one or more (drawer) driving devices for actuating the ladle sliding gate (15).

With this configuration, all the robot (21) needs to do is to collect the driving device (17) from its storing station at the second holding device and couple it to the ladle and ladle sliding gate (15). In case the driving device is stored in the storage rack (29) or in case the driving device stored in the storing station must be changed with a new one stored in the storage rack (29), additionally to coupling the one or more (drawer) driving devices (17, 17*w*) to the ladle and ladle sliding gate (15), the robot (21) must also connect one or more hoses (17*t*) to corresponding (drawer) driving devices to render the driving device operational for actuating the ladle sliding gate.

Figure 1D:
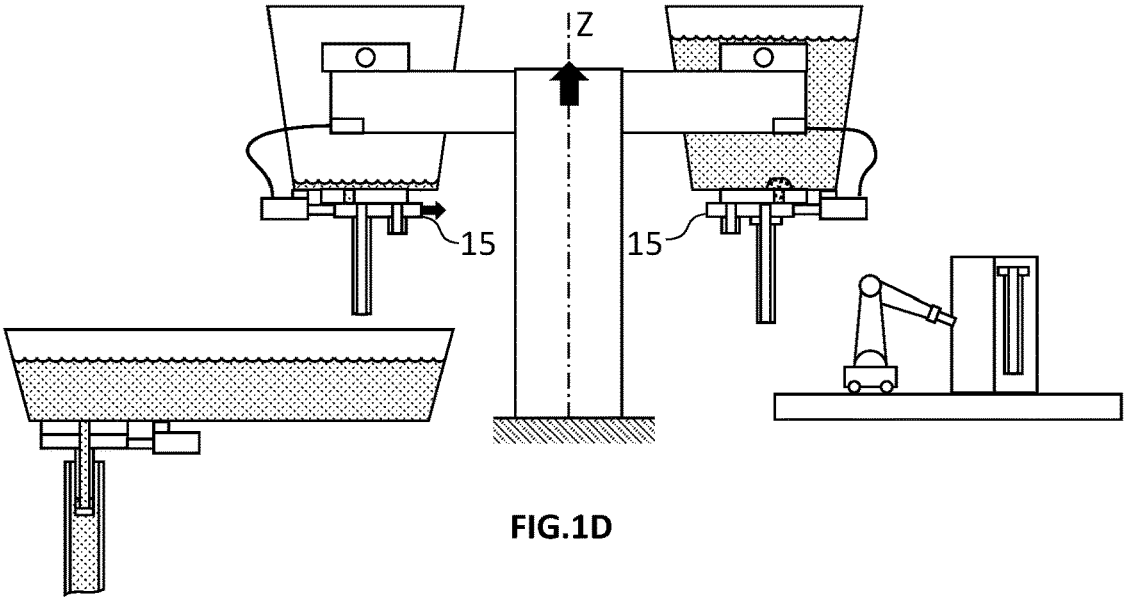
Figure 1E:
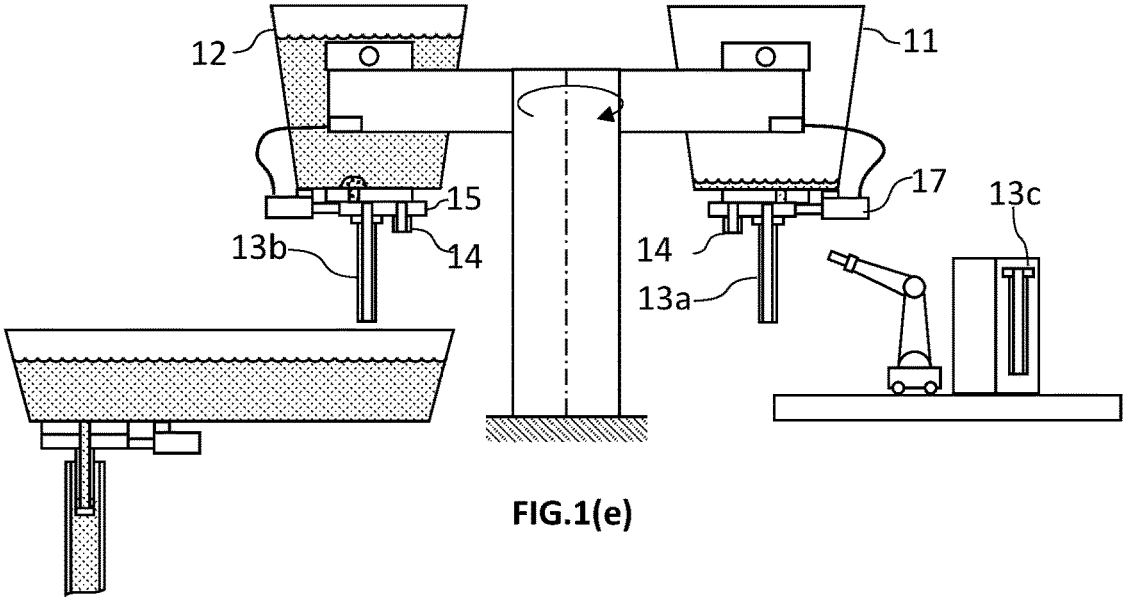
Figure 1F:
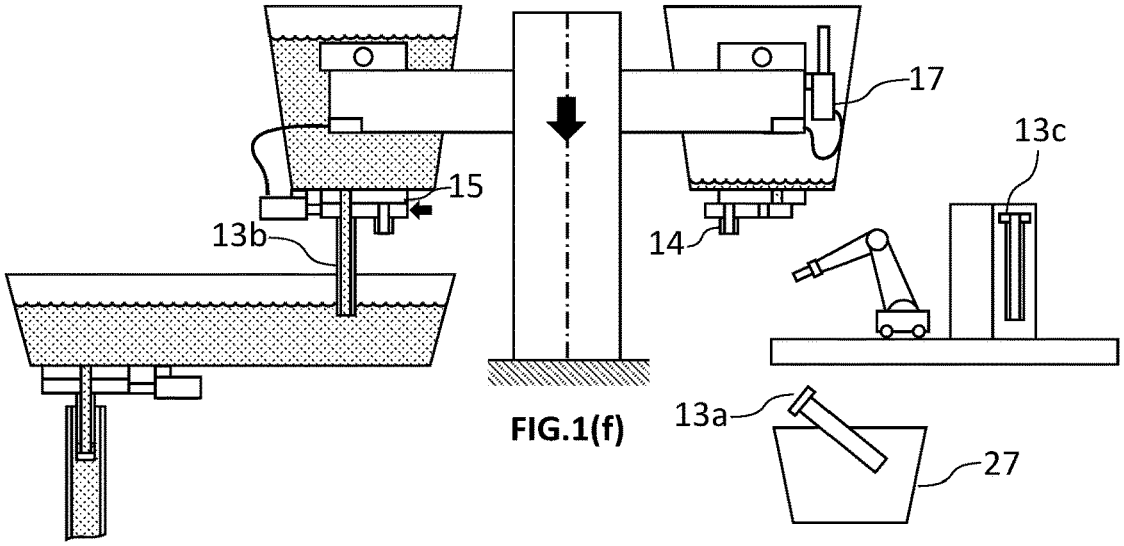

As shown in FIG. 1D, when the first ladle (11) is substantially empty, it must be replaced by the full, second ladle (12) which is waiting at the loading. In the embodiment illustrated in FIG. 1A-F, the turret (30) is configured for raising the first and second ladles (11,12) to a rotating altitude, to ensure that, upon rotation of the turret, the ladle shrouds (13*a*, 13*b*) of the first and second ladles do not collide with the tundish (1) or with any other element of the casting installation. As shown in FIG. 1E the turret (30) is also configured for rotating about a vertical axis (Z) such as to swap in a single movement the positions of the first and second ladles, still maintained at the rotating altitude above the respective loading and casting positions. Finally, the turret (30) must be configured to lower both first and second ladles to their corresponding loading and casting stations as shown in FIG. 1F.

The movements of the turret and of the ladle sliding gates (15) of both first and second ladles must be perfectly synchronized to prevent any undesired dripping or flow of molten metal from any of the first and second ladles.

The robot (21) must also be configured for removing from the emptied first ladle (11) located at the loading station, the ladle shroud (13*a*) and the driving device (17). The spent ladle shroud (13*a*) can be cleaned and stored for further use or it can be disposed of into a disposal bin (27). The driving device (17) can be stored in the storing station on the first holding device of the turret (30) without having to disconnect it from the source of pressurized fluid, or into the storage rack (29) of the loading platform, after having disconnected the source of pressurized fluid therefrom. The emptied first ladle (11) stripped of both ladle shroud (13*a*) and driving device (17) can now be removed to a service station for being refurbished. A new ladle full of molten metal can be brought from the furnace and loaded onto the now empty first holding device of the turret, for starting the whole operations as illustrated in FIGS. 1A to 1F discussed supra.

The Robot (21)

The robot (21) can have at least five, preferably at least six or seven degrees of liberty. The robot is preferably movingly mounted on the loading platform (20) such that the robot can translate parallel to a first axis (X) and/or second axis (Y) normal to the first axis (X), or combination thereof. The robot (21) can preferably rotate about a vertical axis (Z) normal to the first and second axes (X, Y). With these combinations of movements, the robot must be able to reach and retrieve any tool or component from the storage rack (29) and to reach the ladle sliding gate (15) of the first or second ladle (11, 12) which is held at the loading station for carrying out the operations described below. Excellent results were obtained using a Kuka Foundry type Robot KR480.

The robot is configured for coupling a ladle shroud (13*a*-13*c*) and a driving device (17) to a ladle (11, 12) full of molten metal and to the ladle sliding gate (15) thereof. It is also configured for removing off the emptied first or second ladle (11, 12) which is held at the loading station after being moved from the casting station the spent ladle shroud (13*a*-13*c*) and the driving device (17). To avoid brutal thermal shocks, the ladle shroud (13*b*) is preferably enclosed in a pre-heating station prior to being coupled to the ladle sliding gate (15) of the ladle at the loading station. The robot can handle the ladle shroud from the storage rack (29) to the pre-heating station (not shown) and thence to be coupled to the ladle sliding gate (15). Similarly, for removing the ladle shroud off an emptied first ladle (11), the robot can remove it, bring it to a pressurized gas (e.g. oxygen) cleaning station (not shown) and to the pre-heating station or to the storage rack (29) for further use. Alternatively, the robot can dump the ladle shroud into a disposal bin (27) in case it is too worn out for further use.

The robot is also configured for checking the state of a spent ladle shroud (13*a*-13*c*) after removal from an emptied ladle. In a preferred embodiment, the robot is configured for assessing whether the spent ladle shroud can be re-used after cleaning or whether it must be disposed of. This can be achieved with an artificial intelligence programming of the robot which can "learn" to distinguish between spent ladle shrouds which can be re-used or must be disposed of. The robot is also preferably configured for cleaning a spent ladle shroud, advantageously with an oxygen shower, to remove any residue clinging to walls of the spent ladle shroud.

Ladle Sliding Gate (15)

Figure 2A:
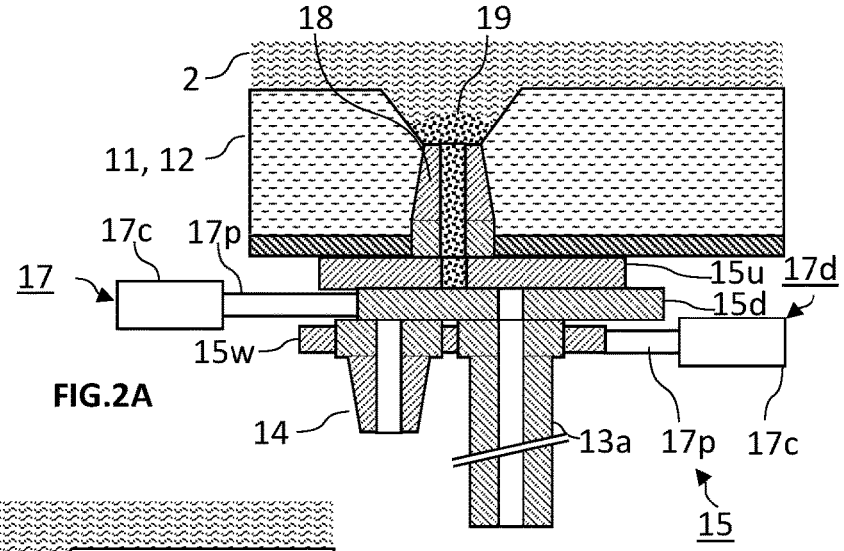
FIG. 2A-D shows various steps of unclogging a clogged ladle outlet using a ladle sliding gate according to a first embodiment of the present invention.
Figure 3A:
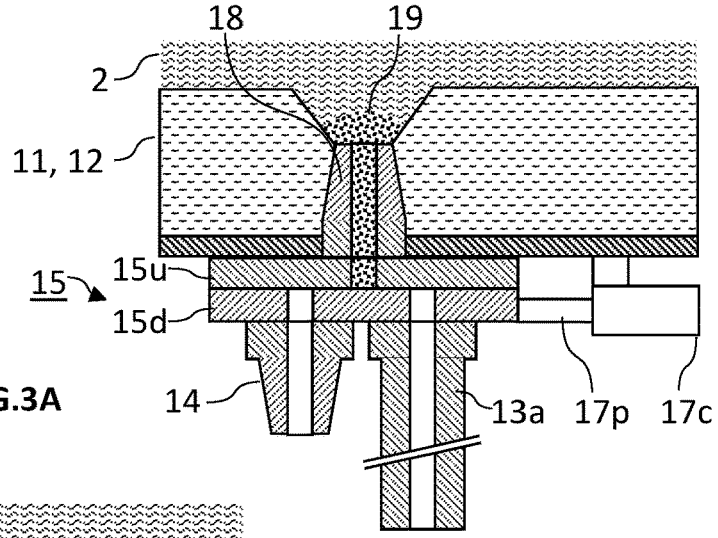
FIG. 3A-D shows various steps of unclogging a clogged ladle outlet using a ladle sliding gate according to a second embodiment of the present invention.

A ladle sliding gate (15) suitable for the present invention comprises an upper plate (15*u*) and a lower plate (15*d*). The upper plate comprises a fixing surface and a bottom sliding surface separated from one another by a thickness of the upper plate, and an upper bore extending from the fixing surface to the bottom sliding surface. The fixing surface of the upper plate is rigidly fixed to a lower portion of the corresponding first or second ladle (11, 12) with the upper bore in fluid communication with the opening (110, 120). The opening is generally formed by a downstream end of an inner bore of an inner nozzle (18), as illustrated in FIGS. 2A and 3A. During a whole casting operation from a ladle (11, 12) into a tundish (1), the upper plate (15*u*) is fixed with respect to the opening (11*o*, 12*o*) and to the inner nozzle (18).

The lower plate (15*d*) comprises a nozzle sliding surface and a top sliding surface separated from one another by a thickness of the lower plate, as well as one or two lower bores extending from the top sliding surface to the nozzle sliding surface. The lower plate (15*d*) is slidingly mounted such that the top sliding surface can slide in translation along the bottom sliding surface to bring the one or two lower bores in and out of fluid communication with the upper bore. The lower plate can be moved in translation by activating a driving device (17). The driving device can comprise a cylinder (17*c*) rigidly and reversibly coupled to the bottom portion of the first or second ladle (11, 12), and a piston (17*p*) reversibly fixed to the lower plate (15*d*). For example, the driving device (17) can be a hydraulic piston or a pneumatic piston.

In a first embodiment illustrated in FIG. 2A-D, the lower plate (15*d*) comprises one lower bore only. The ladle sliding gate of this embodiment comprises a drawer (15*w*) configured for rigidly holding side-by-side a ladle shroud (13*a*-13*c*) and a collector nozzle (14). The ladle shroud has a shroud bore opening upstream at an upper shroud surface and downstream at a lower shroud end. Similarly, the collector nozzle (14) has a collector bore opening upstream at an upper collector surface and downstream at a lower collector end. As well known in the art, the collector nozzle is substantially shorter than the ladle shroud, such that when the ladle is at the casting position, the lower collector end is well clear off the tundish and is easily accessible with an unclogging tool (19*r*) such as a staff or a pressurized gas lance. The drawer is movingly mounted such as to translate the upper shroud surface and collector surface along the nozzle sliding surface of the lower plate (15*d*) between,

- a shroud position, wherein the shroud bore is in fluid communication with the lower bore
- a collector position, wherein the collector bore is in fluid communication with the lower bore, and preferably
- a sealed position wherein a downstream end of the lower bore is sealed and is in fluid communication with neither the ladle bore nor the collector bore.

The sealed position of the drawer (15*w*) is preferred but not essential, since flow from the ladle can be stopped by moving the lower bore of the lower plate out of registry with the upper bore of the upper plate. Like the lower plate, the drawer (15*w*) can be moved in translation by activating a drawer driving device (17*w*). The drawer driving device can comprise a cylinder (17*c*) rigidly and reversibly coupled to the bottom portion of the first or second ladle (11, 12), and a piston (17*p*) reversibly fixed to the drawer (15*w*). For example, the drawer driving device (17*w*) can be a hydraulic piston or a pneumatic piston. Actuating the drawer driving device (17*w*) allows moving the drawer (15*w*) to bring the shroud bore and the collector bore in and out of registry with the lower bore.

FIGS. 2A to 2D show various steps for initiating a casting operation from a ladle (11, 12) to a tundish (1) with a ladle sliding gate according to the first embodiment. FIG. 2A shows a new ladle (11, 12) having reached the casting station. The ladle sliding gate is in the sealed position with the lower bore of the lower plate (15*d*) being out of registry from the upper bore of the upper plate (15*u*). The inner bore of the inner nozzle (18) as well as the upper bore are filled with a plugging material (19), which can be sand or any other particulate material, for preventing freezing of the sliding mechanism by solidified metal. The drawer (15*w*) can be positioned at the shroud position with the shroud bore in fluid communication with the lower bore. No metal is allowed to flow through the ladle, since the downstream end of the upper bore is sealed by the lower plate. In the present document, upstream and downstream are defined according to the intended direction of flow of metal melt. Once the ladle is at the casting station, casting can start.

Figure 2B:
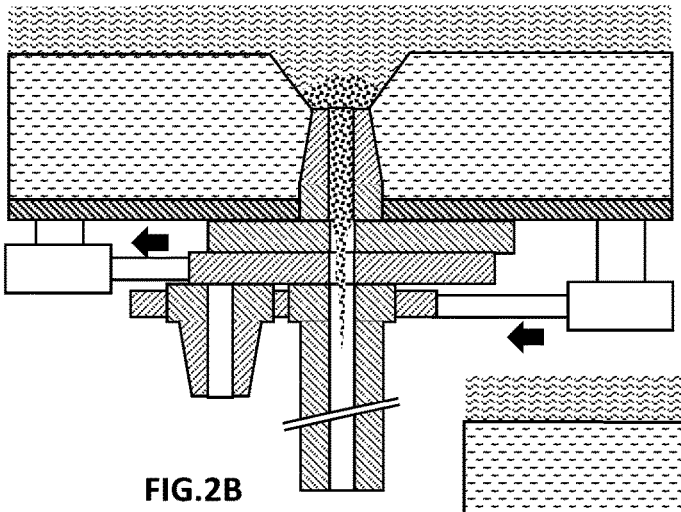

As shown in FIG. 2B, to start casting, the driving device (17) translates the lower plate and ladle shroud until bringing the lower bore and ladle bore in fluid communication with the upper bore, thus forming a continuous flow channel from the inner bore to the shroud bore. In normal conditions, the plugging material (19) flows out through the lower bore and shroud bore, driven by the pressure of the molten metal in the ladle. Once the plugging material (19) has been evacuated, molten metal flows out of the ladle through the shroud bore. This operation takes a few seconds, and casting from the tundish to the tool can proceed continuously. In some cases, however, the plugging material may form a solidified mass by molten metal percolating therethrough and solidifying forming a binder between the particles of the plugging material (19). Depending on the size and resistance of the thus solidified mass, this can lead to a clogging of the inner bore and upper bore, and no molten metal can flow out of the ladle. This situation is more the exception than the rule, but when it happens, it poses a serious problem to a casting operation. For this reason, many operators are reluctant to fix the ladle shroud (13*a*-13*c*) to the ladle sliding gate (15) and prefer to use a robot to hold the ladle shroud in position when the ladle is at the casting station. With a ladle sliding gate (15) according to the present embodiment, a clogged inner bore and/or upper bore can be unclogged very rapidly, even with a ladle shroud (13*a*-13*c*) fixed to the drawer (15*w*), as follows.

Figure 2C:
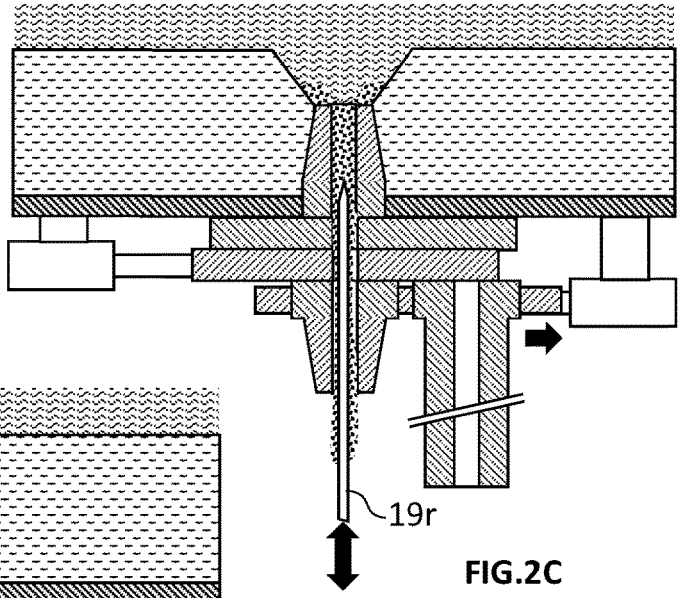

As illustrated in FIG. 2C; the drawer driving device (17*w*) translates the drawer (15*w*) such as to bring the collector nozzle (14) in fluid communication with the lower bore and upper bore. Since the collector nozzle is substantially shorter than the ladle shroud, leaving enough clearing above the tundish, it is easy to introduce an unclogging tool (19*r*) through the downstream end of the collector nozzle, through the lower and upper bores and up to the inner bore. The unclogging tool can be a metal staff which can be used to break the solidified mass by hitting the thus solidified plugging material. Alternatively, the unclogging tool (19*r*) can be a pressurized gas lance, projecting a jet of pressurized gas, such as oxygen. The unclogging tool (19*r*) can be handled manually or by a robot.

Figure 2D:
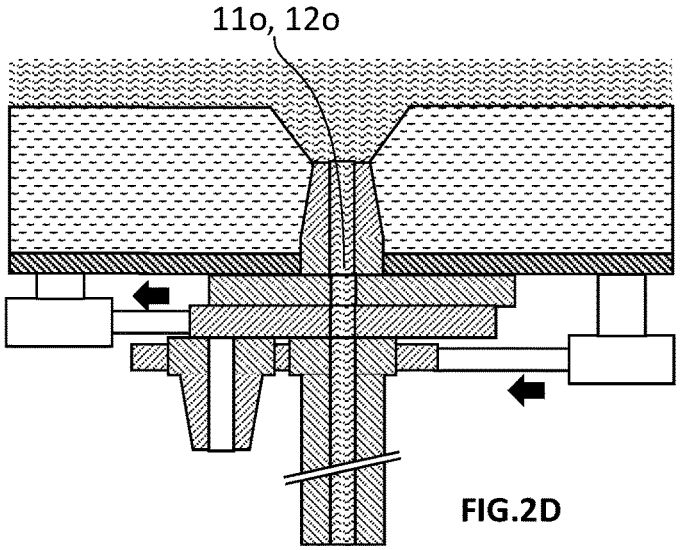

As soon as the solid mass is disrupted, the particles of plugging material (19) start flowing out through the collector nozzle and, as shown in FIG. 2D, casting can start normally. The drawer (15*w*) can be translated such as to bring the ladle bore in fluid communication with the lower and upper bores and with the inner bore to start the casting operation. If the drawer comprises a sealing position as defined supra, between the collector position and the ladle position, then the lower plate (15*d*) needs not be moved when translating the drawer (15*w*). If it does not, the lower plate (15*d*) can be moved to the sealing position prior to moving the drawer between the collector and the ladle positions.

In a second embodiment illustrated in FIGS. 3A to 3D, the lower plate (15*d*) comprises a first bore and a second bore, each extending from the top sliding surface to the nozzle sliding surface. The lower plate (15*d*) is slidingly mounted such that the top sliding surface can slide along the bottom sliding surface to bring each of the first and second bores in and out of fluid communication with the upper bore. The nozzle surface is configured for being rigidly and reversibly coupled to the ladle shroud (13*a*-13*c*) with the ladle bore in fluid communication with the first bore, and with the collector bore in fluid communication with the second bore. The ladle shroud (13*a*-13*c*) and the collector nozzle. The nozzle sliding surface of the lower plate (15*d*) in this second embodiment does not have any sliding function. During a whole casting operation from a ladle (11, 12) into a tundish (1), the ladle shroud (13*a*-13*c*) and the collector nozzle (14) are fixed with respect to the lower plate (15*d*) and remain in registry with the first and second bores, respectively.

FIGS. 3A to 3D show various steps for initiating a casting operation from a ladle (11, 12) to a tundish (1) with a ladle sliding gate according to the second embodiment. FIG. 3A shows a new ladle (11, 12) having reached the casting station. The ladle sliding gate is in the sealed position with both first and second bores of the lower plate (15*d*) being out of registry from the upper bore of the upper plate (15*u*). As in the first embodiment, the inner bore of the inner nozzle (18) as well as the upper bore are filled with a plugging material (19), which can be sand or any other particulate material, for preventing freezing of the sliding mechanism by solidified metal. Neither the molten metal (2) nor the plugging material (19) is allowed to flow through the ladle, since the downstream end of the upper bore is sealed by the lower plate. Once the ladle is at the casting station, casting can start.

Figure 3B:
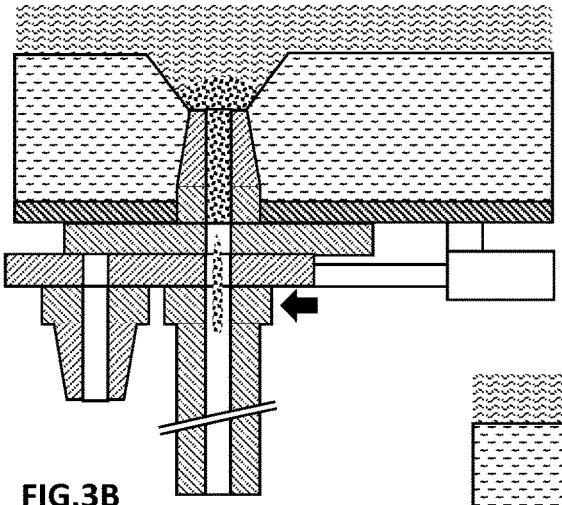

As shown in FIG. 3B, to start casting, the driving device (17) translates the lower plate and ladle shroud (13*a*-13*c*) until bringing the first bore and ladle bore in fluid communication with the upper bore, thus forming a continuous flow channel from the inner bore to the shroud bore. In normal conditions, the plugging material (19) flows out through the lower bore and shroud bore, driven by the pressure of the molten metal in the ladle. Once the plugging material (19) has been evacuated, molten metal flows out of the ladle through the shroud bore. This operation takes a few seconds, and casting from the tundish to the tool can proceed continuously. As discussed with the first embodiment, however, in some cases, a solidified mass of plugging material (19) can clog the inner and upper bores, so that no molten metal can flow out of the ladle and the passage must be unclogged. With a ladle sliding gate (15) according to the present embodiment, a clogged inner bore and/or upper bore can be unclogged very rapidly, even with a ladle shroud (13*a*-13*c*) fixed to the lower plate (15*d*), as follows.

Figure 3C:
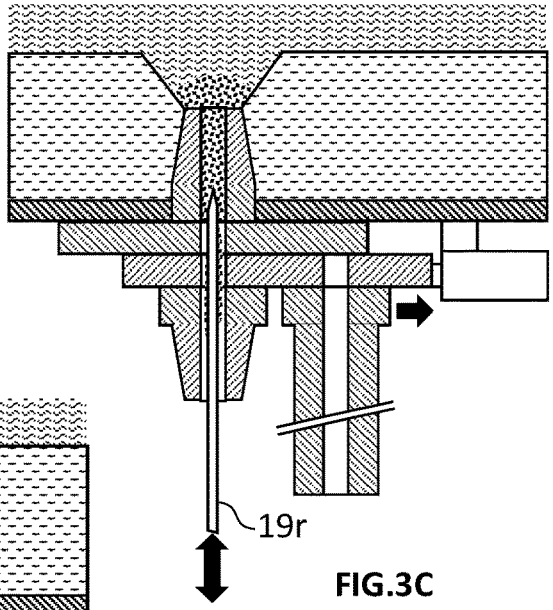

As shown in FIG. 3C, the driving device (17) translates the lower plate (15*d*) such as to bring the second bore and the collector nozzle (14) in fluid communication with the upper bore. Since the collector nozzle is substantially shorter than the ladle shroud, leaving enough clearing above the tundish, it is easy to introduce an unclogging tool (19*r*) through the downstream end of the collector nozzle, through the lower and upper bores and up to the inner bore. The unclogging tool can be a metal staff or a pressurized gas lance and they can be used to unclog the passage as discussed with respect to the first embodiment. The unclogging tool (19*r*) can be handled manually or by a robot.

Figure 3D:
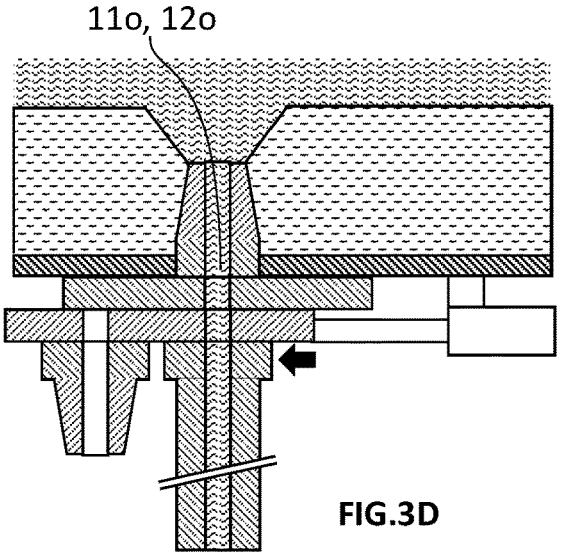

As soon as the solid mass is disrupted, the particles of plugging material (19) start flowing out through the collector nozzle and, as shown in FIG. 3D, casting can start normally. The lower plate (15*d*) can be translated such as to bring the first bore and ladle bore in fluid communication with the upper bore and with the inner bore to start the casting operation.

In all embodiments of ladle sliding gates (15), the driving device (17) can be actuated hydraulically or pneumatically or electrically. Each of the at least first holding device and second holding device of the ladle turret is preferably provided with a source of pressurized fluid for actuating the driving device (17) and, if it comprises a drawer (15*w*), for actuating the drawer driving device (17*w*), via a hose (17*t*). In a preferred embodiment, each of the at least first holding device and second holding device of the ladle turret also comprises a storing unit for storing the driving device (17) and the drawer driving device (17*w*) if there is a drawer (15*w*), when the (drawer) driving device(s) (17) is (are) not coupled to the ladle sliding gate (15), as shown in FIGS. 1A, 1B, and 1F. The (drawer) casting devices (17, 17*w*) can also be stored in the storage rack on the loading platform. It is, however, preferred to store them on the first and second holding devices, because this way, the driving devices (17, 17*w*) can be permanently coupled via the hose (17*t*) to the source of hydraulic or pneumatic fluid (17*h*). This saves the robot (2&) from having to carry out a complex operation of coupling the hose (17*t*) to the newly coupled driving device(s) (17, 17*w*), which would have to be carried out in case the driving devices (17, 17*w*) were stored in the storage rack (29) on the loading platform.

Method for Casting Molten Metal

The present invention also concerns a method for casting molten metal (2) from a ladle (11, 12) into a tundish (1) in a casting installation as discussed supra, with the first ladle (11) being full of molten metal and being located at the casting station and the second ladle (12) being full of molten metal and being at the loading station. As illustrated in FIG. 1A, the ladle sliding gate (15) of the first ladle (11) is in the sealed position and is provided with a ladle shroud (13*a*-13*c*) and a collector nozzle (14). The lower plate (15*d*) of the ladle sliding gate is coupled to a driving device (17). If the ladle sliding gate (15) is of the type described with respect to the first embodiment supra, comprising a drawer (15*w*), the latter is coupled to a drawer driving device (17*w*). The ladle sliding gate (15) of the second ladle (12) is in the sealed position and comprises no ladle shroud. The ladle sliding gate (15) of the second ladle (12) is not coupled to any (drawer) driving device (17, 17*w*).

In order to start casting molten metal from the first ladle (11) through the ladle shroud (13*a*) into the tundish (2), the ladle sliding gate (15) of the first ladle (11) is brought into casting position. This operation is performed by actuating the driving device (17). The first ladle (11) discharges the molten metal (2) contained therein into the tundish (1) until the first ladle is considered emptied.

As the first ladle (11) is discharging its content into the tundish, the robot (21) loads a new ladle shroud (13*b*) onto the ladle sliding gate (15) of the second ladle (12) (cf. FIG. 1B). As illustrated in FIG. 1C, the robot (21) also couples the driving device (17) and optionally the drawer driving device (17*w*) to the sliding plate gate (15) of the second ladle (12). As discussed supra, this operation is made simpler if the first and second holding devices of the turret (30) are provided with a storing unit for storing one or more (drawer) driving devices (17, 17*w*), because the one or more (drawer) devices can thus remain coupled to the source (17*h*) of pressurized fluid via the hose (17*t*) during a whole casting operation involving emptying several (more than two) ladles into the tundish. If the one or more (drawer) driving devices (17, 17*w*) are stored elsewhere, typically in the storage rack (29) located on the loading platform (20), the robot (21) must additionally couple one or more hoses (17*t*) to corresponding one or more (drawer) driving devices to render them operational. During the whole operation on the second ladle (12) the ladle sliding gate remains in the sealed position.

As shown in FIG. 1D, when the first ladle is substantially empty, the ladle sliding gate (15) of the first ladle (11) is brought from the casting position into the sealed position to interrupt any flow of molten metal out of the first ladle (11). The positions of the first and second ladles are swapped by moving the first ladle (11) from the casting station to the loading station and, concomitantly, moving the second ladle (12) from the loading station to the casting station. The position swapping of the first and second ladles (11, 12) can be performed as follows. FIG. 1D illustrates how the turret (30) can lift the first and second ladles (11, 12) until the ladle shrouds (13*a*, 13*b*) of the first and second ladles are both clear off and higher than the tundish in a vertical direction (Z), defining a rotating altitude. The turret can thus rotate without any risk of a ladle shroud (13*a*, 13*b*) of the first or second ladle (11, 12) colliding with the tundish or with any other component of the casting installation. FIG. 1E illustrates the rotation of the turret about the vertical axis (Z) by 180° to bring the emptied first ladle (11) above the loading station, and to bring the filled second ladle (12) above the casting station and above the tundish (2). During the rotation operation, the first and second ladles are constantly maintained at their rotating altitude. At this stage, the first and second ladles (11, 12) can be lowered to their respective loading and casting stations, the ladle shroud (13*b*) of the second ladle being inserted in the tundish (2).

The ladle sliding gate (15) of the second ladle (12) can be brought into casting position such that molten metal can flow from the second ladle (12) through the ladle shroud (13*b*) into the tundish (2). The whole swapping operation from closing the ladle sliding gate of the first ladle (11) to opening the ladle sliding gate of the second ladle (12) can last less than 2 min, preferably less than 1 min more preferably less than 30 s, and the level of molten metal in the tundish can easily be restored to a stationary casting level.

The emptied first ladle (11) parked at the loading station can now be stripped of the ladle shroud to allow the removal and transportation thereof across the workshop to a refurbishing station (not shown). The spent ladle shroud (11*a*) can be removed from the ladle sliding gate (15) of the emptied first ladle (11) with the robot (21). The spent ladle shroud (13*a*) can be stored for refurbishing and cleaning (not shown) or as waste in a disposal bin (27) as shown in FIG. 1F.

As illustrated in FIG. 1F, the robot (21) can also decouple and remove the one or more (drawer) driving devices (17, 17*w*) from the sliding plate gate (15) of the first ladle (11) and storing them for further use. if the first and second holding devices of the turret (30) are provided with a storing unit for storing one or more (drawer) driving devices (17, 17*w*), then the robot (21) needs not disconnect the corresponding one or more hoses (17*t*) prior to storing them, since the source (17*h*) of hydraulic or pneumatic fluid or the source of electric power is also located at the first and second holding devices. If, on the other hand, the one or more driving devices (17, 17*w*) stored in the storage rack (29) located on the loading platform (20), then the robot must also disconnect the one or more hoses (17*t*) from the corresponding one or more (drawer) driving devices (17, 17*w*) prior to storing them in the storage rack (29). The same applies if a (drawer) driving device must be changed because defective.

The emptied first ladle, stripped of the ladle shroud (13*a*) and of the one or more (drawer) driving means (17, 17*w*) can be removed from the first holding device by a crane to a refurbishing station (not shown), where the ladle can be cleaned, repaired, and made ready for being filled with a new load of molten metal from a furnace. A new ladle full of molten metal can be loaded onto the now empty first holding device of the ladle turret (30) at the loading station wherein, like the second ladle (12) in step (a), the new ladle comprises a ladle sliding gate (15) in the sealed position and comprising no ladle shroud (13*a*-13*c*) and no (drawer) driving device (17, 17*w*). The cycle depicted in FIGS. 1A to 1(*f*) can thus be repeated, and casting from the tundish to a tool can proceed continuously, with the level of molten metal in the tundish being substantially constant throughout the continuous casting operation, with little fluctuations when swapping the positions of the emptied ladle (11) and a filled ladle (12) defined in step (e). Said fluctuations can be very small since, when functioning optimally, the swapping operation is very swift.

In case step (e) of swapping positions of the first and second ladles does not proceed optimally, because the inner and/or upper bores are clogged with solidified plugging material, the use of ladle sliding gate (15) comprising both ladle shroud (13*a*-13*c*) and collector nozzle (14) side-by-side allows a rapid and efficient un-clogging of the inner and/or upper bores by using an appropriate unclogging tool (19*r*) through the collector bore, as described supra in the section entitled "LADLE SLIDING GATE (15)." This way, the interruption of metal flow into the tundish is reduced to a minimum. Absent this option of rapid un-clogging through the collector bore, many operators would be reluctant to fix a ladle shroud (13*a*-13*c*) to a bottom of a ladle at the loading station, with or without a robot (21), because unclogging the inner and upper bores with a ladle shroud fixed to the ladle sliding gate would require returning the clogged ladle to the loading station and replacing the ladle shroud by a collector nozzle to allow un-clogging with an unclogging tool (19*r*), then coupling again the ladle shroud and bringing the ladle back to the casting station. All these operations would take too long, with a risk of metal freezing, which was to be prevented by the use of a plugging material. Furthermore, a long period without feeding the tundish with molten metal could provoke the interruption of the casing operation, which must be avoided by all means.

In a preferred embodiment, the loading operations of a second ladle (12) stationed at the loading station are carried out in the following order: (1) coupling of the (drawer) driving device(s) to the ladle sliding gate (15), followed by the coupling of a new ladle shroud (13*b*). The unloading operations of an emptied first ladle (11) stationed at the loading station are preferably carried out in the following order: (1) uncoupling of the spent ladle shroud (13*b*), followed by uncoupling of the (drawer) driving device(s) from the ladle sliding gate (15).

The present invention offers an automated metal casting installation, wherein a fresh ladle can be made ready for casting by a robot (21) at the loading station, without any additional risk of casting disruption into the tool compared with conventional metal casting installations.

| REF | DESCRIPTION |
|---|---|
| 1 | Tundish |
| 2 | Molten metal |
| 3 | Casting tool |
| 5 | Tundish sliding gate |
| 11 | First ladle |
| 11o | Opening of first ladle |
| 12 | Second ladle |
| 12o | Opening of second ladle |
| 13a-13c | Collector nozzle |
| 14 | Lade shroud |
| 15 | Ladle sliding gate |
| 15d | Lower plate of ladle sliding gate |
| 15u | Upper plate of ladle sliding gate |
| 15w | Drawer |
| 17 | Driving device |
| 17c | Cylinder |
| 17h | Source of hydraulic/pneumatic fluid |
| 17p | Piston |
| 17t | Hose |
| 17w | Drawer driving device |
| 18 | Inner nozzle |
| 19 | Plugging material |
| 19r | Unplug rod |
| 20 | Loading platform |
| 21 | Robot |
| 25 | Pre-heating oven |
| 27 | Disposal bin |
| 29 | Storage rack |
| 30 | Ladle turret |

The invention claimed is:

1. A metal casting installation comprising, (a) a loading platform (20), (b) a tundish (1), (c) a first ladle (11) and a second ladle (12), each of the first and second ladle comprising, a floor provided with an opening (11*o*, 12*o*), a collector nozzle (14) and a ladle shroud (13*a*-13*c*), a ladle sliding gate (15), (d) a turret (30) comprising at least a first holding device and a second holding device for holding the first ladle (11) and the second ladle (12), respectively, wherein the ladle turret is configured for moving and holding in place the first and second ladles (11,12) between a loading station, adjacent to the loading platform (20), and a casting station, over the tundish (1), Characterized in that, the ladle sliding gate is configured for reversibly receiving and supporting the collector nozzle and the ladle shroud, and further configured for being coupled to a driving device (17) for actuating the ladle sliding gate between a sealed position wherein the opening is sealed, a casting position wherein the opening is in fluid communication with the ladle shroud (13*a*-13*c*), and an unclogging position wherein the opening is in fluid communication with the collector nozzle (14), the metal casting installation comprises a robot (21) programmed for carrying out the following operations on the first or second ladle (11, 12) which is held in the loading station, loading a new ladle shroud (13*b*) onto the ladle slide gate (15), and coupling a driving device (17) to the ladle slide gate (15), wherein said robot (21) is located on or adjacent to the loading platform (20).

2. The metal casting installation according to claim 1, wherein the loading platform (20) comprises a tool storage rack (29) containing one or more spare ladle shrouds (13*b*, 13*c*) within reaching distance of the robot (21).

3. The metal casting installation according to claim 2, wherein the robot (21) is movingly mounted on the loading platform (20) such that the robot can translate parallel to a first axis (X) and/or second axis (Y) normal to the first axis (X), or combination thereof, and/or rotate about a vertical axis (Z) normal to the first and second axes (X, Y), in order to reach and retrieve any tool or component from the storage rack (29) and to reach the ladle sliding gate of the first or second ladle (11, 12).

4. The metal casting installation according to claim 2, wherein the tool storage rack (29) further comprises one or more driving devices (17) and/or spare collector nozzles (14).

5. The metal casting installation according to claim 1, wherein the robot (21) is configured for removing off the emptied first or second ladle (11, 12) which is held at the loading station after being moved from the casting station, the ladle shroud (13*a*-13*c*) and the driving device (17).

6. The metal casting installation according to claim 1, wherein the ladle sliding gate (15) comprises, (a) an upper plate (15*u*) comprising, a fixing surface and a bottom sliding surface separated from one another by a thickness of the upper plate, an upper bore extending from the fixing surface to the bottom sliding surface, and wherein the fixing surface of the upper plate is rigidly fixed to a lower portion of the corresponding first or second ladle (11, 12) with the upper bore in fluid communication with the opening, (b) a lower plate (15*d*) comprising, a nozzle sliding surface and a top sliding surface separated from one another by a thickness of the lower plate, a lower bore extending from the top sliding surface to the nozzle sliding surface, wherein the lower plate (15*d*) is slidingly mounted such that the top sliding surface can slide in translation along the bottom sliding surface to bring the lower bore in and out of fluid communication with the upper bore, and wherein (c) a drawer (15*w*) configured for rigidly holding a ladle shroud (13*a*-13*c*) having a shroud bore opening at an upper shroud surface and a collector nozzle (14) having a collector bore opening at an upper collector surface, the drawer being movingly mounted such as to translate the upper shroud surface and collector surface along the nozzle sliding surface of the lower plate (15*d*) between a shroud position, wherein the shroud bore is in fluid communication with the lower bore and a collector position, wherein the collector bore is in fluid communication with the lower bore, (d) the driving device (17) being coupled to the lower plate (15*d*) for driving the translation of the lower plate, and (e) a drawer driving device (17*w*) being coupled to the drawer (15*w*) for driving the translation of the drawer, wherein the driving device (17) is coupled to the lower plate (15*d*) and comprises a cylinder (17*c*) rigidly and reversibly coupled to the bottom portion of the corresponding first or second ladle (11, 12), and a piston (17*p*) rigidly and reversibly fixed to the lower plate (15*d*), the driving device being configured for moving the lower plate to bring the lower bore in and out of registry with the upper bore, and wherein the drawer driving device (17*w*) is coupled to the drawer (15*w*) and comprises a cylinder (17*c*) rigidly and reversibly coupled to the bottom portion of the corresponding first or second ladle (11, 12), and a piston (17*p*) rigidly and reversibly fixed to the drawer (15*w*), the drawer driving device being configured for moving the drawer to bring the shroud bore and the collector bore in and out of registry with the lower bore.

7. The metal casting installation according to claim 1, wherein the ladle sliding gate (15) comprises, (a) an upper plate (15*u*) comprising, a fixing surface and a bottom sliding surface separated from one another by a thickness of the upper plate, an upper bore extending from the fixing surface to the bottom sliding surface, and wherein the fixing surface of the upper plate is rigidly fixed to a lower portion of the corresponding first or second ladle (11, 12) with the upper bore in fluid communication with the opening, (b) A lower plate (15*d*) comprising, a nozzle surface and a top sliding surface separated from one another by a thickness of the lower plate, a first bore and a second bore, each extending from the top sliding surface to the nozzle surface, wherein the lower plate (15*d*) is slidingly mounted such that the top sliding surface can slide along the bottom sliding surface to bring each of the first and second bores in and out of fluid communication with the upper bore, and wherein the nozzle surface is configured for being rigidly and reversibly coupled to the ladle shroud (13*a*-13*c*) having a ladle bore in fluid communication with the first bore, and to the collector nozzle having a collector bore in fluid communication with the second bore, and wherein the driving device (17) is coupled to the lower plate (15*d*) and comprises a cylinder (17*c*) rigidly and reversibly coupled to the bottom portion of the corresponding first or second ladle (11, 12), and a piston (17*p*) rigidly and reversibly fixed to the lower plate (15*d*), the driving device being configured for moving the lower plate to bring the first and second bores in and out of registry with the upper bore.

8. The metal casting installation according to claim 1, wherein, the driving device (17) is actuated hydraulically or pneumatically or electrically, and wherein each of the at least first holding device and second holding device of the ladle turret is provided with, a source of pressurized fluid for activating the driving device (17) via a hose (17*t*), or a source of electric power.

9. The metal casting installation according to claim 8, wherein each of the at least first holding device and second holding device of the ladle turret further comprises a storing station for storing a driving device (17) ready for coupling to a ladle sliding gate.

10. The metal casting installation according to claim 1, comprising a pre-heating oven (25) for bringing and maintaining at a pre-heating temperature the new ladle shroud (13*b*) loaded on the ladle sliding gate (15) of the first or second ladle (12) located at the loading station.

11. The metal casting installation according to claim 1, wherein the robot is also configured, for checking a state of a spent ladle shroud (13*a*-13*c*) after removal from an emptied ladle, for assessing whether the spent ladle shroud can be re-used after cleaning or whether it must be disposed of, and for cleaning the spent ladle shroud, with an oxygen shower, to remove any residue clinging to walls of the spent ladle shroud.

12. A method for casting a molten metal comprising (a) providing a metal casting installation according to claim 1, wherein, the first ladle is full of molten metal (2) and is in the casting station and the second ladle (12) is full of molten metal (2) and is in the loading station, the ladle sliding gate (15) of the first ladle (11) is in the sealed position, is coupled to one or more driving devices (17) and optionally drawer driving devices (17*w*), and is provided with a ladle shroud (13*a*-13*c*) and a collector nozzle (14), the ladle sliding gate (15) of the second ladle (12) is in the sealed position and comprises no ladle shroud (13*a*-13*c*) and no operational driving device (17) and no operational drawer driving device (17*w*), (b) bringing the ladle sliding gate (15) of the first ladle (11) into casting position for casting molten metal from the first ladle (11) through the ladle shroud (13*a*) into the tundish (2), (c) during the preceding step, loading with the robot (21) a new ladle shroud (13*b*) onto the ladle sliding gate (15) of the second ladle (12), and coupling with the robot (21) the driving device (17) to the sliding plate gate (15) of the second ladle (12), (d) When the first ladle is substantially empty, bringing the ladle sliding gate (15) of the first ladle (11) into sealed position, followed by (e) swapping positions of the first and second ladles by moving the first ladle (11) from the casting station to the loading station and, concomitantly, moving the second ladle (12) from the loading station to the casting station, (f) bringing the ladle sliding gate (15) of the second ladle (12) into casting position and casting molten metal from the second ladle (12) through the ladle shroud (13*b*) into the tundish (2).

13. The method according to claim 12, further comprising the following steps during step (f), (g) removing with the robot (21) the spent ladle shroud (11*a*) from the ladle sliding gate (15) of the emptied first ladle (11) and storing the spent ladle shroud for refurbishing or as waste, and (h) de-coupling and removing with the robot (21) the one or more driving devices (17) from the sliding plate gate (15) of the first ladle (11), and storing them for further use, (i) removing the emptied first ladle (11), and (j) loading a new ladle full of molten metal onto the first holding device of the ladle turret (30) at the loading station wherein, like the second ladle (12) in step (a), the new ladle comprises a ladle sliding gate (15) in the sealed position and comprising no ladle shroud (13*a*-13*c*).

14. The method according to claim 12, wherein the opening of the first ladle is filled with a plugging material (19) and in case no molten metal flows out of the opening upon bringing the ladle sliding gate (15) of the first ladle (11) into casting station in step (b), the following steps are carried out, bringing the ladle sliding gate (15) of the first ladle (11) into unclogging position, with an appropriate unclogging tool (19*r*), unclogging the opening of the first ladle by disrupting the plugging material, when the plugging material starts flowing out of the collector nozzle, bringing the ladle sliding gate (15) of the first ladle (11) into casting position for casting molten metal from the first ladle (11) through the thus unplugged opening and through the ladle shroud (11*a*) into the tundish (2).

15. The method according to claim 12, wherein step (e) of swapping positions of the first and second ladles comprises lifting the first and second ladles (11, 12) until the ladle shrouds (13*a*, 13*b*) of the first and second ladles are both clear off and higher than the tundish in a vertical direction (Z), rotating the turret about the vertical axis (Z) by 180° to bring the first ladle (11) above the loading station, and to bring the second ladle (12) above the casting station and above the tundish (2), lowering the first and second ladles (11, 12) to their respective loading and casting stations, the ladle shroud (13*b*) of the second ladle being inserted in the tundish (2).

16. The method according to claim 12, wherein the robot also, checks a state of a spent ladle shroud (13*a*-13*c*) after removal from an emptied ladle, assesses whether the spent ladle shroud can be re-used after cleaning or whether it must be disposed of, and cleans the spent ladle shroud, with an oxygen shower, to remove any residue clinging to walls of the spent ladle shroud.

* * * * *